United States Patent [19]

Colbachini et al.

[11] 4,074,790

[45] Feb. 21, 1978

[54] VEHICLE-BORNE INSPECTION AND MAINTENANCE APPARATUS

[76] Inventors: Daciano Colbachini; Romeo Chiarotto, both of piazza Costello nr. 16, Padua, Italy

[21] Appl. No.: 722,608

[22] Filed: Sept. 13, 1976

[30] Foreign Application Priority Data

Feb. 27, 1976 Italy ..... 41536/76

[51] Int. Cl.[2] ..... E04G 1/36; E04G 3/10

[52] U.S. Cl. ..... 182/63; 182/2; 182/150

[58] Field of Search ..... 182/63, 2, 141, 150, 182/148; 212/144

[56] References Cited

U.S. PATENT DOCUMENTS

| | | | |
|---|---|---|---|
| 2,669,490 | 2/1952 | Kaufman | 182/63 |
| 3,076,522 | 2/1963 | Goodell | 182/63 |
| 3,262,517 | 7/1966 | Malec | 182/2 |
| 3,357,517 | 12/1967 | Wagner | 182/2 |
| 3,498,474 | 3/1970 | Pierce | 182/2 |
| 3,596,735 | 8/1971 | Denier | 182/63 |
| 3,608,669 | 9/1971 | Lindsay | 182/63 |

*Primary Examiner*—Reinaldo P. Machado
*Attorney, Agent, or Firm*—Bacon & Thomas

[57] ABSTRACT

A self-propelled truck has a rotatable turret on which an articulated and nested assembly of frame members and a scaffold is mounted for transport. The turret and assembly can be operated to place the frame members in position to define a vertically extending portion outwardly of one side of the truck to extend, for example, downwardly of the side of a bridge on which the truck is located. The scaffold then extends horizontally from the lower end of the vertical portion and may be swung horizontally to extend either parallel to the side of the bridge or to extend inwardly under the bridge. The scaffold is also vertically movable and wheeled stabilizers on the truck can hold the same against tilting while permitting movement of the truck across the bridge with the assembly extended as described.

5 Claims, 4 Drawing Figures

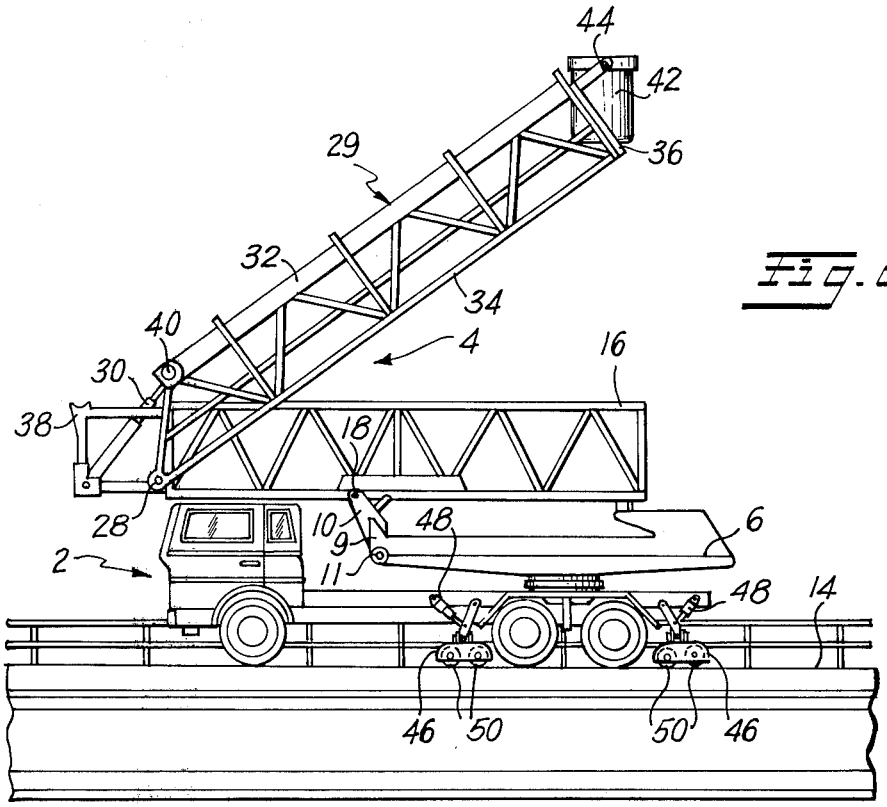
Fig. 2.
Fig. 3.
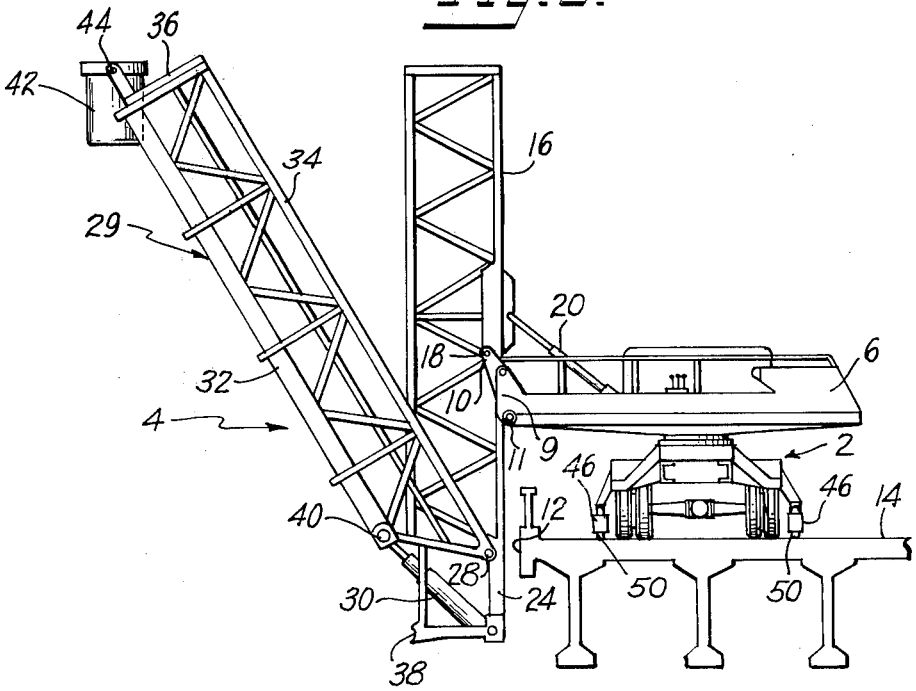

VEHICLE-BORNE INSPECTION AND MAINTENANCE APPARATUS

BACKGROUND OF THE INVENTION

This invention is in the field of adjustable scaffolding and/or inspection devices and particularly such devices mounted on wheeled vehicles.

It is customarily necessary to inspect such structures as bridges or the like wherein access to the sides and the under surfaces is difficult to obtain. Many such structures require periodic inspection and/or maintenance but no satisfactory mobile device has heretofore been provided rendering ready access to the various surfaces or portions to be inspected or maintained.

SUMMARY OF THE INVENTION

The present invention comprises an articulated arrangement of frame members mounted on a self-propelled wheeled vehicle and in which the nested arrangement can be unfolded and extended to provide a scaffold or platform for personnel that may be moved along exterior vertical surfaces or caused to project under a bridge or the like adjacent the lower surfaces thereof to support workmen in position to inspect and/or repair a structure. The invention further contemplates such a device that can be transported along the surface being inspected.

It is, therefore, a principal object of this invention to provide an improved mobile scaffold arrangement for use on bridges or the like.

BRIEF DESCRIPTION OF THE DRAWINGS

FIG. 2 is a view similar to FIG. 1, on a reduced scale, but showing the framework in partly extended condition.

FIG. 3 is a rear view of the apparatus of FIG. 2 with the parts shown in a further extended position.

DESCRIPTION OF A PREFERRED EMBODIMENT

Figure 1:
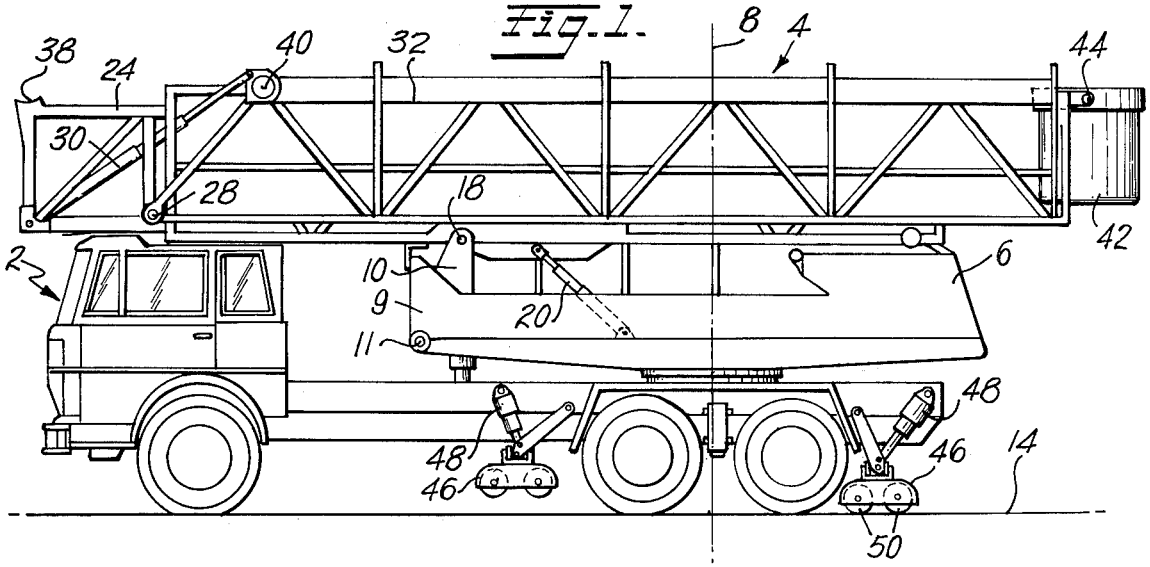
FIG. 1 is a schematic view of a vehicle having the articulated framework of the present invention nested thereon.
Figure 4:
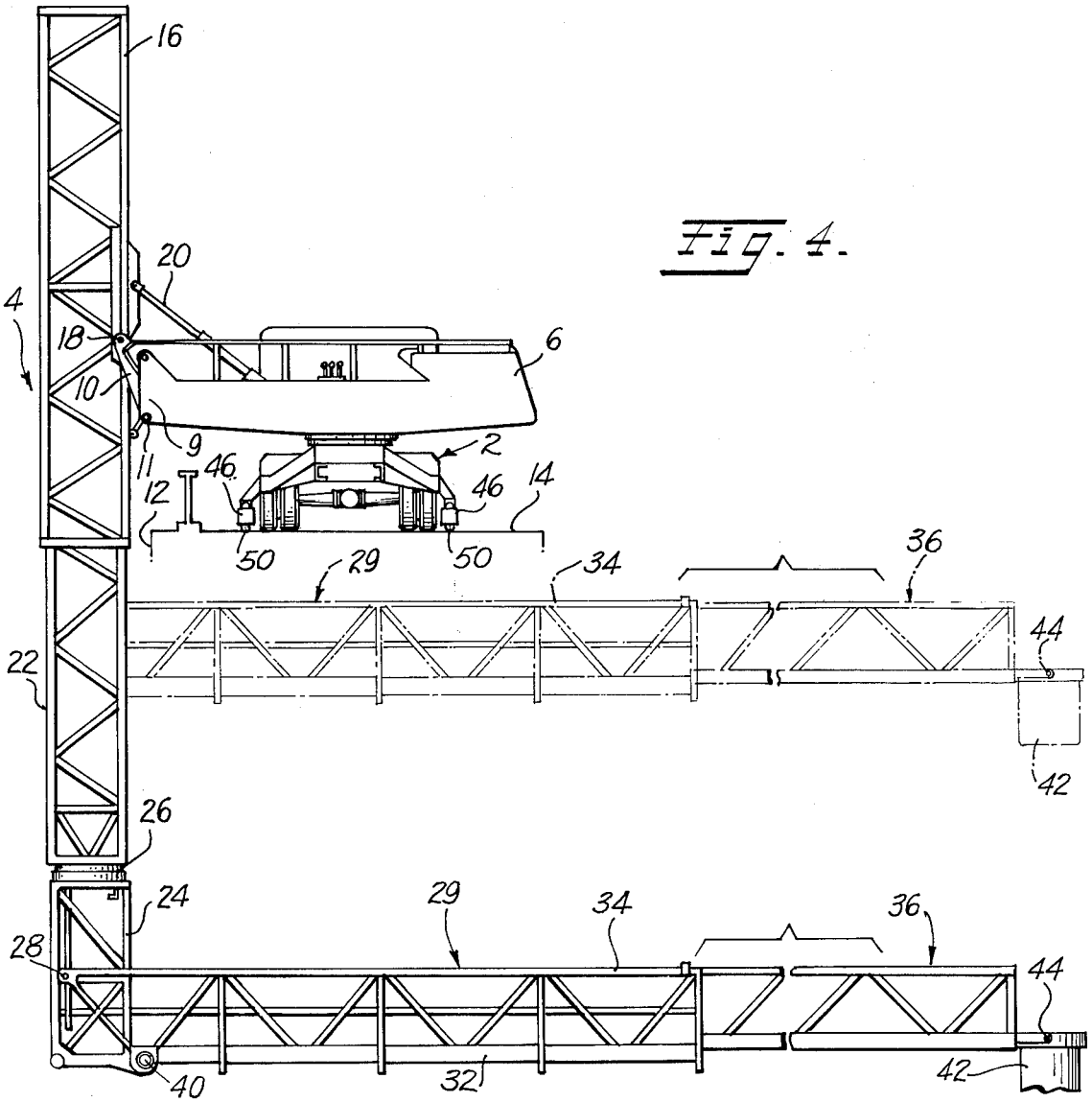
FIG. 4 is a view similar to FIG. 3 but showing the apparatus unfolded and positioned to inspect the under surface of a bridge.

FIG. 1 shows a motorized vehicle 2 on which an articulated and nested assembly of frame members 4 is mounted. The vehicle 2 is a self-propelled truck or the like having thereon a turret device 6 rotatable about a vertical axis 8 extending generally upwardly from the region of the rear wheels of the truck. Referring next to FIG. 4, the frame assembly 4 may be unfolded and extended to the general arrangement shown. It is to be noted that the turret 6 has been rotated so that one end 9 thereof extends laterally of the truck 2 to a position generally over the outer edge 12 of a bridge or the like 14 on which the truck is supported. The framework as extended includes a first frame member 16 of generally rectangular sectional shape pivotally mounted on axis 18 on a swing frame 10 pivoted to the end 9 of the turret 6 by pivot means 11. When assembly 4 is as shown in FIG. 1, the swing frame 10 is in a rearward position. When jack 20 is actuated to erect the assembly as shown in FIG. 4, it also swings frame 10 forwardly to position pivot 18 farther from vehicle 2. Telescopically slidable within the first frame member 16 is a second frame member 22 which may be slidably extended downwardly by any suitable actuating mechanism such as a further hydraulic motor device, pinnion and rack or other mechanism (not shown). A third frame member 24 is supported at the lower end of frame member 22 by a suitable turntable or pivot device 26 by which the lower frame member 24 may be rotated about a vertical axis when in the position of FIG. 4. Pivotally secured to the lower frame member 24 is a scaffold assembly 29. The assembly 29 is pivoted to the frame member 24 about a pivot 28 near the lower end thereof. Any suitable hydraulic jack mechanism such as that shown at 30 in FIGS. 2 and 3 may be employed to swing the scaffold 29 about its pivot 28. The scaffold assembly 29 defines a platform 32 capable of supporting one or more workmen and side rails 34, only one of which appears in FIG. 4. In general, the scaffold assembly 29 is of U-shape in cross section with the side rails 34 spaced laterally apart a distance slightly greater than the width of the first frame member 16 referred to above. Thus, when the frame member 22 is telescopically housed within frame member 16 and the frame member 24 rotated 180° from the position shown in FIG. 4 the scaffold assembly 29 may be swung as suggested in FIGS. 2 and 3 to embrace the first and second frame members and to assume the compact nested relationship shown in FIG. 1. Telescopically carried by the scaffold assembly 29 is an auxiliary scaffold assembly 36 of similar shape but smaller in size so that it can telescopically slide longitudinally in the assembly 29. Any suitable means may be employed to effect such sliding movement. As best indicated in FIGS. 2 and 3, the lower frame member 24 is provided with saddle devices 38 arranged to receive laterally extending trunnions 40 on scaffold assembly 29 to thereby provide firm and stable support for the scaffold assembly when in the position of FIG. 4.

Preferably, the outer end portion of scaffold assembly 36 pivotally supports a personnel bucket 42 pivotally suspended therefrom about an axis 44.

The truck 2 is also provided with a plurality of stabilizer devices 46 mounted on the truck and under the control of hydraulic jacks 48 whereby the stabilizers may be raised or lowered. During transport of the vehicle along a highway or the like, the stabilizers are in the raised position. The front stabilizer of FIG. 1 is shown in such raised position whereas the rear stabilizer is shown in a lowered position wherein rollers 50 journalled thereon are in contact with the road surface. As clearly evident from FIG. 4, when the stabilizers are lowered into contact with the road, they offer substantial lateral stability to the entire apparatus.

When the vehicle of the invention reaches a position on the supporting structure 14 wherein it is desired to extend the scaffold for inspection or repair services, the stabilizers 46 are preferably first lowered into contact with the road as shown in FIG. 2. If desired, personnel may first enter the bucket 42 and the scaffold assembly 29 may then be pivoted upwardly to the position shown in FIG. 2 by suitable actuation of the hydraulic jack 30. In this position, personnel in the bucket 42 may inspect or repair overhead structures. If inspection of surfaces below the road surface is desired, after the scaffold assembly 29, has been raised as described, the turret 6 may be rotated to the position of FIG. 3 and by actuation of hydraulic jack device 20, the first frame member 16 may be then swung upwardly to the position of FIG. 3 and in this position the weight of the scaffold assembly 26 will tend to rotate or swing the same way downwardly to a horizontal position but the rate thereof may be controlled by controlling exhaust of fluid from the hydraulic jack 30. When the scaffold assembly 29 reaches a horizontal position, the second frame member 22 may be lowered sufficiently to project the member 24 outwardly of member 26 and thus permit rotation of the scaffold assembly in a horizontal plane about the axis of turntable 26. It may be swung to a position parallel with the side of the bridge to permit inspection or repair of the side surfaces thereof and in such condition the vehicle 2 may be driven along the road surface to carry the inspecting personnel longitudinally of the bridge. Also, the scaffold may be raised or lowered in a vertical direction, as indicated by broken line in FIG. 4 when desired or necessary. If the under surfaces of a bridge or the like are to be inspected or serviced, the scaffold assembly 29 may be rotated horizontally to project under the bridge, as shown in FIG. 4, and may be raised or lowered if desired or necessary.

While the controls and specific mechanisms for effecting movement of the different parts described has not been shown, such devices are well known and may be readily devised by those skilled in the art.

While a single specific embodiment of the invention has been shown and described, the same is merely illustrative of the principles involved and other forms may be resorted to within the scope of the appended claims.

We claim:

1. A vehicle-borne inspection and maintenance apparatus comprising a vehicle having a turret rotatable thereon about a generally vertical axis;

a first elongated frame member pivotally mounted at one edge of said turret for pivotal movement in a vertical plane from a horizontal position over said turret to a vertical position outwardly of one end of said turret;

a second frame member slidably movable longitudinally of said first frame member when in said vertical position;

a third frame member pivotally carried by said second frame member, at the lower end thereof, for pivotal movement about the longitudinal axis of said first member; and an elongated scaffold member extending laterally from said third frame member at the lower end thereof and below the level of said vehicle.

2. Apparatus as defined in claim 1 wherein said scaffold member is pivotally supported on said third frame member for pivotal movement from said lateral position to a position parallel to and adjacent said first, second and third frame members.

3. Apparatus as defined in claim 2 wherein said scaffold member comprises at least two elongated telescopically slidable frame members whereby the length of said scaffold member may be adjusted.

4. Apparatus as defined in claim 1 including stabilizing means movably mounted on said vehicle for movement into engagement with a road surface to stabilize said vehicle against tilting.

5. Apparatus as defined in claim 4 wherein said vehicle is a self-propelled wheeled vehicle and wherein said stabilizing means include roadway engaging roller means whereby said vehicle may be driven along said roadway with said stabilizing means engaging said roadway.

* * * * *